US006158817A

United States Patent [19]

Bertrand

[11] Patent Number: 6,158,817

[45] Date of Patent: Dec. 12, 2000

[54] CONCRETE SAW MACHINE FOR GROOVING ABOVE, BELOW, OR BESIDE

[75] Inventor: René Bertrand, St-Jean-sur-Richelieu, Canada

[73] Assignee: Equipement Kotkurb Inc., St-Jean-sur-Richelieu, Canada

[21] Appl. No.: 09/089,253

[22] Filed: Jun. 3, 1998

[51] Int. Cl.[7] ..... B28D 1/04

[52] U.S. Cl. ..... 299/39.3; 299/36.1; 299/72; 299/75

[58] Field of Search ..... 299/36.1, 39.1, 299/39.3, 72, 75; 125/13.03, 13.01, 12, 14

[56] References Cited

U.S. PATENT DOCUMENTS

| | | | |
|---|---|---|---|
| 4,353,278 | 10/1982 | Adachi et al. | 84/655 |
| 4,433,871 | 2/1984 | Bertrand | 299/41.1 |
| 4,572,303 | 2/1986 | Marechal | 173/39 |
| 4,792,190 | 12/1988 | Bertrand | 299/41 |
| 4,832,412 | 5/1989 | Bertrand | 299/39.3 |
| 5,230,270 | 7/1993 | Bertrand | 83/489 |
| 5,676,125 | 10/1997 | Kelly et al. | 125/13.03 |

*Primary Examiner*—Eileen D. Lillis
*Assistant Examiner*—John Kreck
*Attorney, Agent, or Firm*—Robic

[57] ABSTRACT

A machine is disclosed, for making a groove into a ceiling, wall or floor. The machine has a powered truck-like vehicle having a support base and an apparatus mounted on the base. The apparatus has two parallel spaced-apart booms pivotally mounted on the base and a holding head slidably mounted on each boom. An elongated main rail mounted on the heads in such a way that it may rotate about a longitudinal axis parallel to itself. A saw carrier is mounted on the main rail and a motorized saw is mounted on the saw carrier. The saw carrier can move along the main rail and the saw can be displaced on the saw carrier in a direction perpendicular to the longitudinal axis. The main rail is mounted on the heads with curved support members which are each pivotally connected to the respective head for rotation about the longitudinal axis. Each curved support member has a first end on which the main rail is mounted, so as to allow the main rail to pivot about a transversal axis perpendicular to the longitudinal axis. Each curved support member has a second end linked to the respective head in such a way that the curved support member can pivot about in connection to the respective head for levering the first end of the curved support member and, therefore, for rotating the main rail about the longitudinal axis. Each opposite end of the main rail has an extendible leg for stabilizing the apparatus whenever required. This leg can be oriented in a third direction perpendicular to the longitudinal axis and perpendicular to a surface. Each leg can be attached at two different places in such a way that it extends less more or further.

20 Claims, 13 Drawing Sheets

FIG. 8
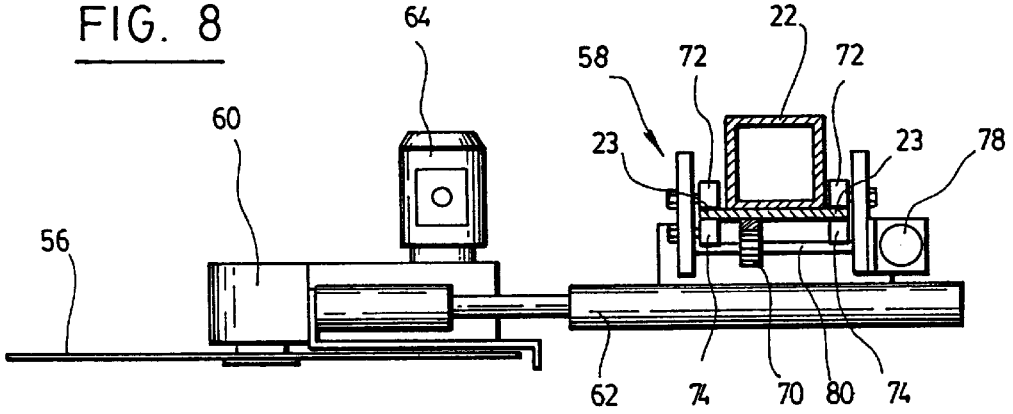
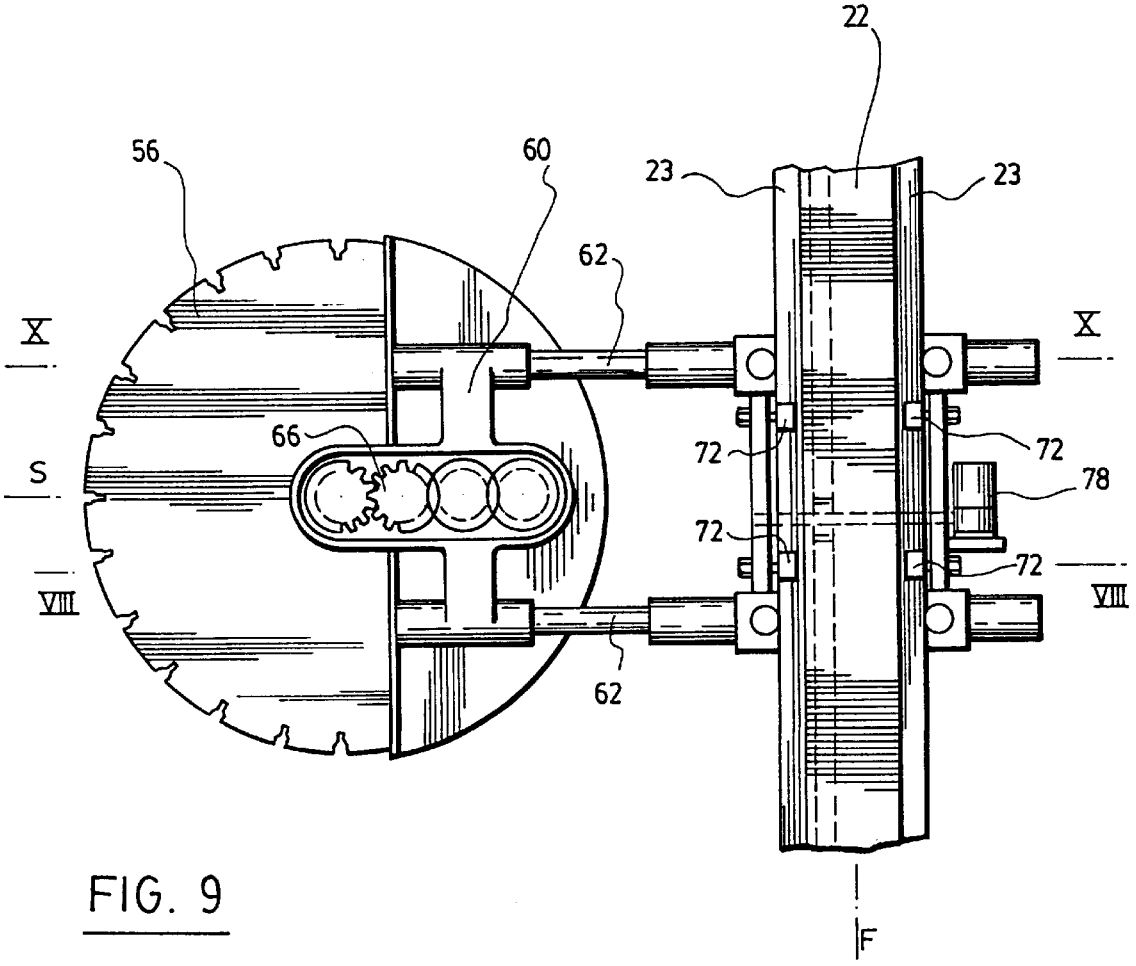
FIG. 9

CONCRETE SAW MACHINE FOR GROOVING ABOVE, BELOW, OR BESIDE

FIELD OF THE INVENTION

The present invention relates to a machine for making a groove into a concrete surface or the like, which can be floor, wall or a ceiling. This machine is an improvement to the machine disclosed and claimed in Canadian patent no.1253, 420 granted on May 2, 1989, and its U.S. counterpart no. 4,792,190 granted on December, 1988, to the same applicant.

BACKGROUND OF THE INVENTION

The machine disclosed and claimed in the above patent is designed for cutting curbstones, sidewalks or the like. The movements of the saw are restricted to the cutting of floor-like surfaces. This machine does not permit enough rotation of the saw so as to be directed towards the upper portion of a wall or a ceiling for cutting the same. Moreover, this machine does not include any supporting means which are appropriate to stabilize the saw while it is in operation, because such is actually not necessary when the saw is exclusively used to cut curbstones or sidewalks.

There is presently a need for a machine for the cutting of wall-like surfaces and ceiling-like surfaces in order to, for example, make a groove into the walls and ceiling of a road tunnel.

SUMMARY OF THE INVENTION

The object of the present invention is to provide a machine for making a groove into any kind of surface which is made of concrete or any other hard material, whatever be the position of such a surface (floor, wall, or ceiling).

More particularly, the object of the present invention is to provide a machine including a powered truck-like vehicle having a support base and an apparatus mounted on the base for making a groove into a surface, the apparatus comprising:

- two spaced-apart booms, the two booms being parallel to each other and each having one end pivotally mounted on the base;
- tilting means mounted on the base to tilt the parallel booms vertically in unison about their one ends;
- a rail-structure-holding head slidably mounted on each of the parallel booms;
- sliding means to slide each head separately along its respective boom;
- an elongated main rail having a pair of opposite ends;
- means for mounting the main rail on said heads for rotation about a longitudinal axis parallel to said elongated main rail, the means for mounting the main rail comprising:
  - curved support members, each support member pivotally connected to its respective head for rotation about said longitudinal axis, and having a first end on which the main rail is pivotably mounted by support means about a transversal axis perpendicular to the longitudinal axis, and a second end;
  - power means extending between the second end of each curved support member and the respective head for levering the first end of the curved support member and, therefore, for rotating the main rail about the longitudinal axis;
- a saw carrier mounted on the main rail;

- displacing means for moving the saw carrier along the main rail along a first direction parallel to the longitudinal axis;
- a motorized saw mounted on the saw carrier;
- means on the saw carrier for displacing the saw on the saw carrier in a second direction perpendicular to the first direction; and
- a powered extendable by mounted on each opposite end of the main rail for stabilizing said apparatus whenever required.

As can be appreciated, the machine according to the present invention, gives the saw enough freedom to be directed towards an upper wall or a ceiling and for cutting therein.

According to a preferred embodiment of the invention, the saw carrier of the machine holds a motor which is offset with respect to the saw and operates the saw through a gearing. This feature makes it possible to cut relatively deep grooves into a surface since the motor operating the saw is offset with respect to the saw and does not interfere with the surrounding surface.

According to another preferred embodiment of the invention, each leg has a remote end with a foot attached to it. Means are provided for orienting each leg in a third direction perpendicular to the longitudinal axis and perpendicular to the surface in such a way that each foot lies on the surface and thus stabilizes the apparatus.

According to still another preferred embodiment of the invention, each end of the main rail of the machine further includes a supporting element extendable in a given direction perpendicular to the longitudinal axis. This element comprises a first portion indirectly attached to the respective end of the main rail and a second telescopically mounted portion. The second portion has a remote end on which a foot is mounted, and fixation means on which the remote end of the leg is connected after removal of the corresponding foot.

These two preferred features are designed to stabilize the saw with the legs which may lie on a floor for making a groove therein, or on a wall for making a groove in an adjacent ceiling.

The invention and its advantages will be better understood upon reading the non restrictive description of a preferred embodiment thereof, made with reference to the appended drawings.

BRIEF DESCRIPTION OF THE DRAWINGS

FIG. 8 is a cross-sectional view taken along line VIII—VIII of FIG. 9 showing the spacer wheels and powered pinion wheel of the saw carrier.

FIG. 9 is a partial cross-sectional view taken along a horizontal plane of the saw.

NUMERAL REFERENCES USED FOR THE ELEMENTS SHOWN IN THE DRAWINGS

Figure 1:
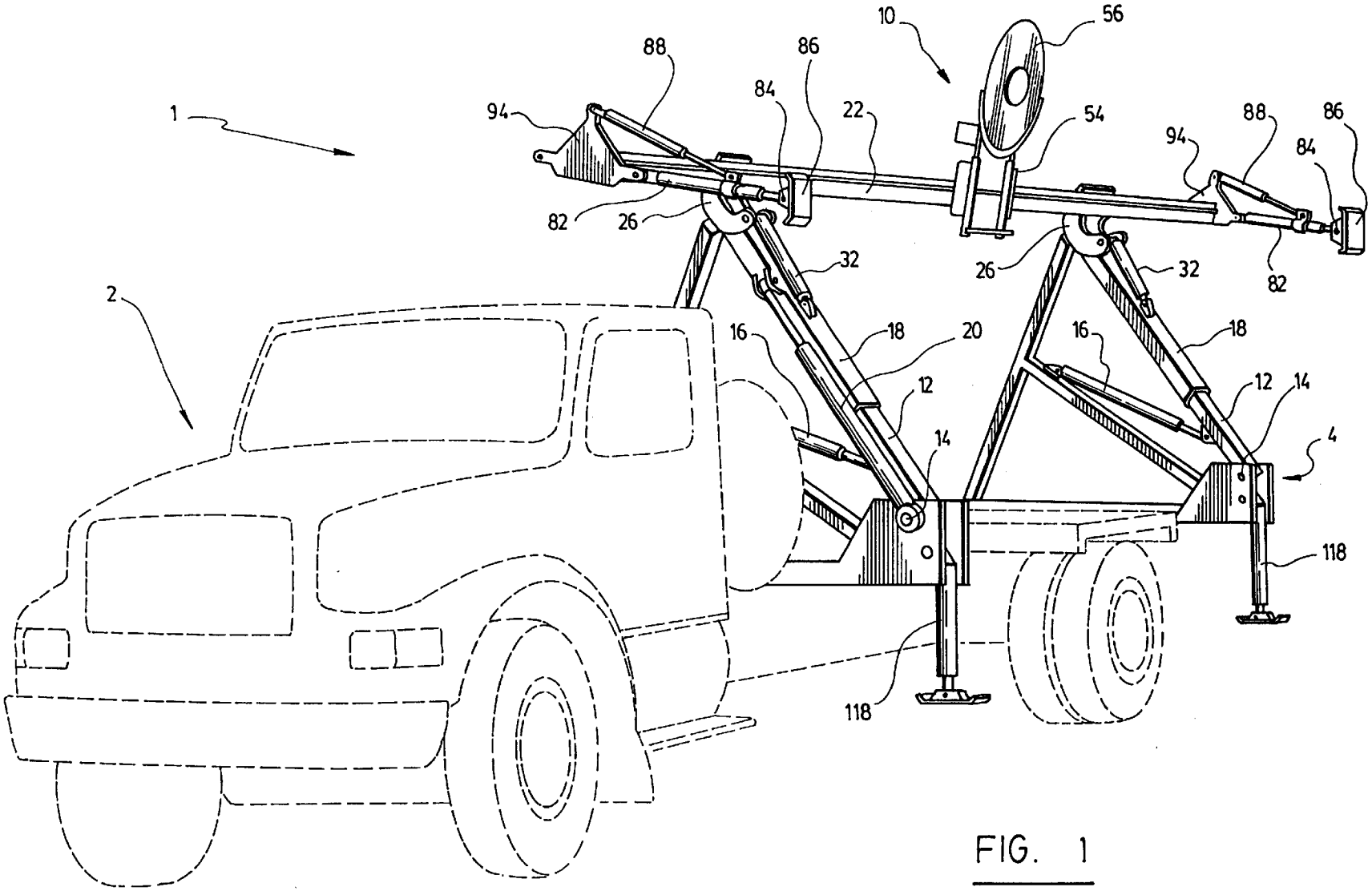
FIG. 1 is a perspective view of a truck on which a machine according to the invention is mounted.

1 machine
2 powered truck-like vehicle
4 support base
10 apparatus
12 booms
14 one end of the booms
16 powered jacks of the tilting means
18 rail-structure-holding heads
20 powered jacks of the sliding means
22 main rail
23 opposite borders of the main rail
24 opposite end of the main rail
26 curved support members
28 first end of the curved support members
30 second end of the curved support members
32 powered jacks extending between curved support members and heads
34 pin extending along the longitudinal axis L
36 holes in the extensions of the head
38 extensions of the heads
40 holes in the curved support member
42 first plate of the support means
44 second plate of the support means
46 bolts
48 spacers
50 nuts
52 pivot pin extending along the transversal axis T
54 saw carrier
56 saw
58 first part of the saw carrier
60 second part of the saw carrier
62 powered jacks for displacing the saw in the second direction S
64 motor of the saw
66 gearing of the motor
68 toothed rack
70 powered pinion wheel
72 upper spacer wheels
74 lower spacer wheels
76 side spacer wheels
78 motor of the pinion wheel
80 rod of the pinion wheel
82 powered extendible legs
84 remote ends of the legs
86 foot of the legs
88 powered jack of the orienting means
90 first place to attach the legs
92 second place to attach the legs
94 triangular support plate
96 first tip of the triangular support plates
98 second tip of the triangular support plates
100 third tip of the triangular support plates
102 adaptors
104 third place to attach the supporting elements
106 supporting elements
108 first portion of the supporting elements
110 second portion of the supporting elements
112 remote end of the second portion
114 foot of the supporting elements
116 fixation means of the supporting elements
118 legs of the support base

DESCRIPTION OF A PREFERRED EMBODIMENT

Figure 2:
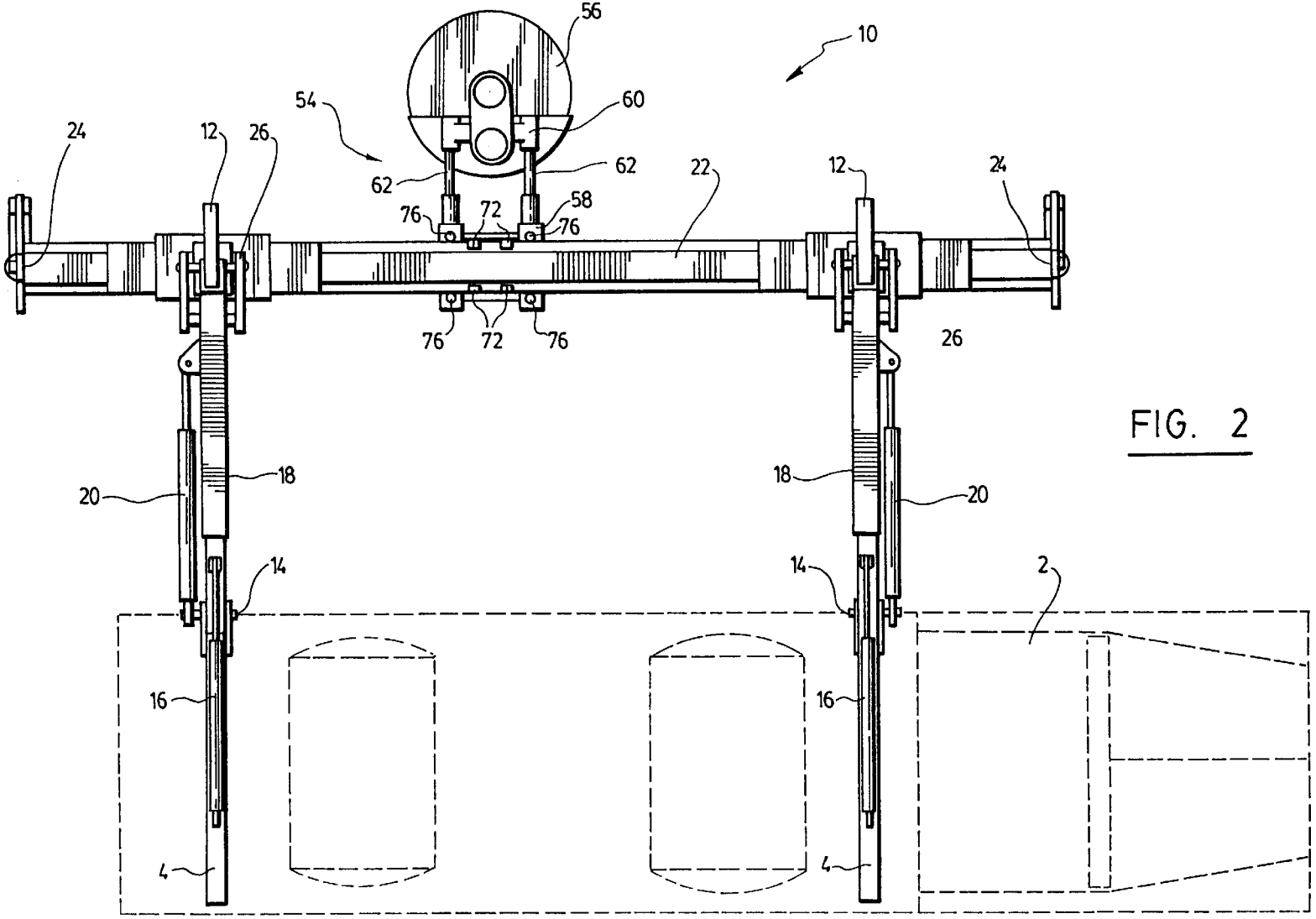
FIG. 2 is a top plan view of the machine shown in FIG. 1, with its booms and saw in a lateral extension.

As shown in FIGS. 1 and 2, the machine (1) according to a preferred embodiment of the invention includes a powered truck-like vehicle (2) having a support base (4). It also includes an apparatus (10) mounted on the base (4) for making a groove into a surface. The surface could be made of concrete or any other hard material.

Figure 3:
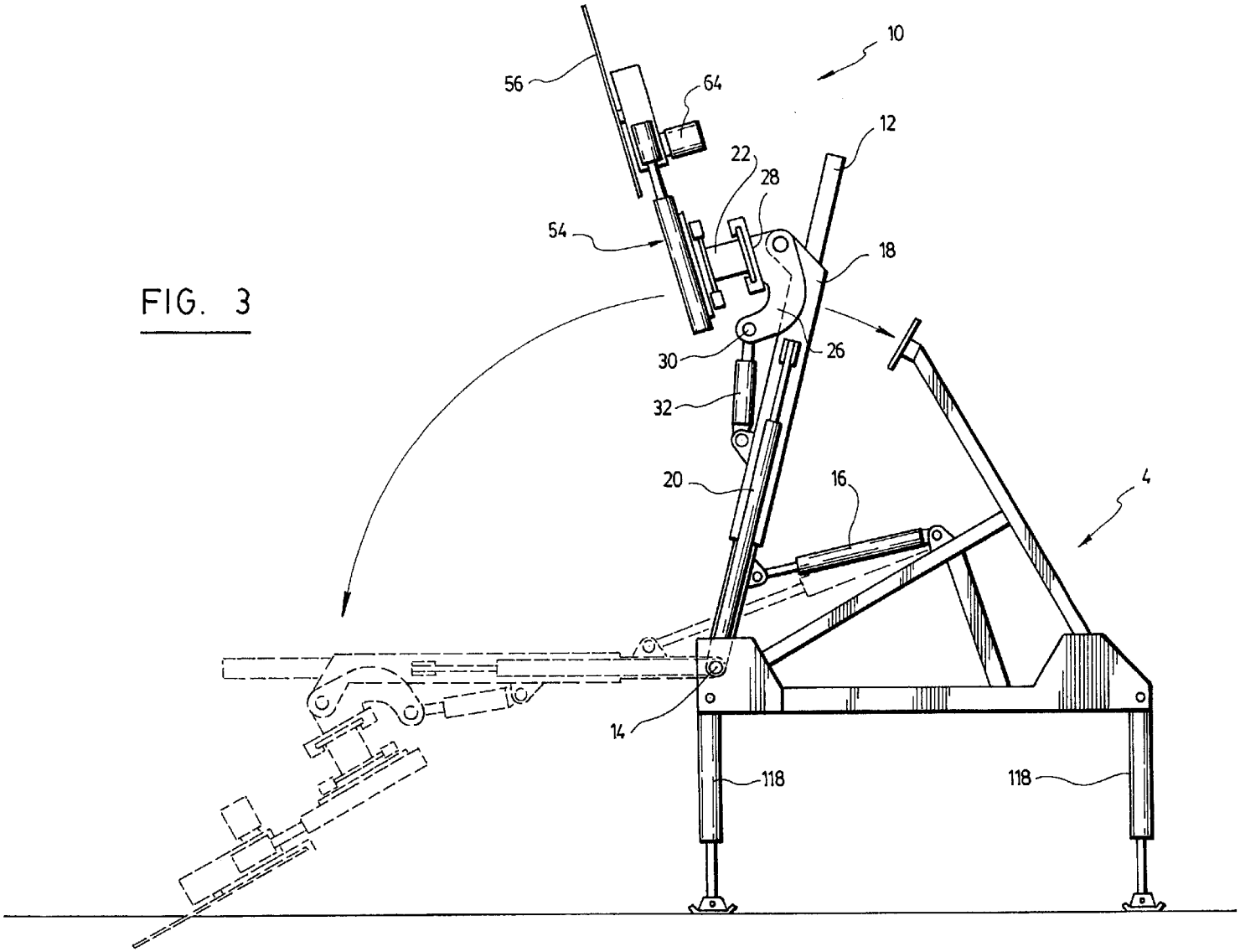
FIG. 3 is a side elevational view of the machine according to the invention showing the booms in horizontal and lifted up positions.
Figure 5:
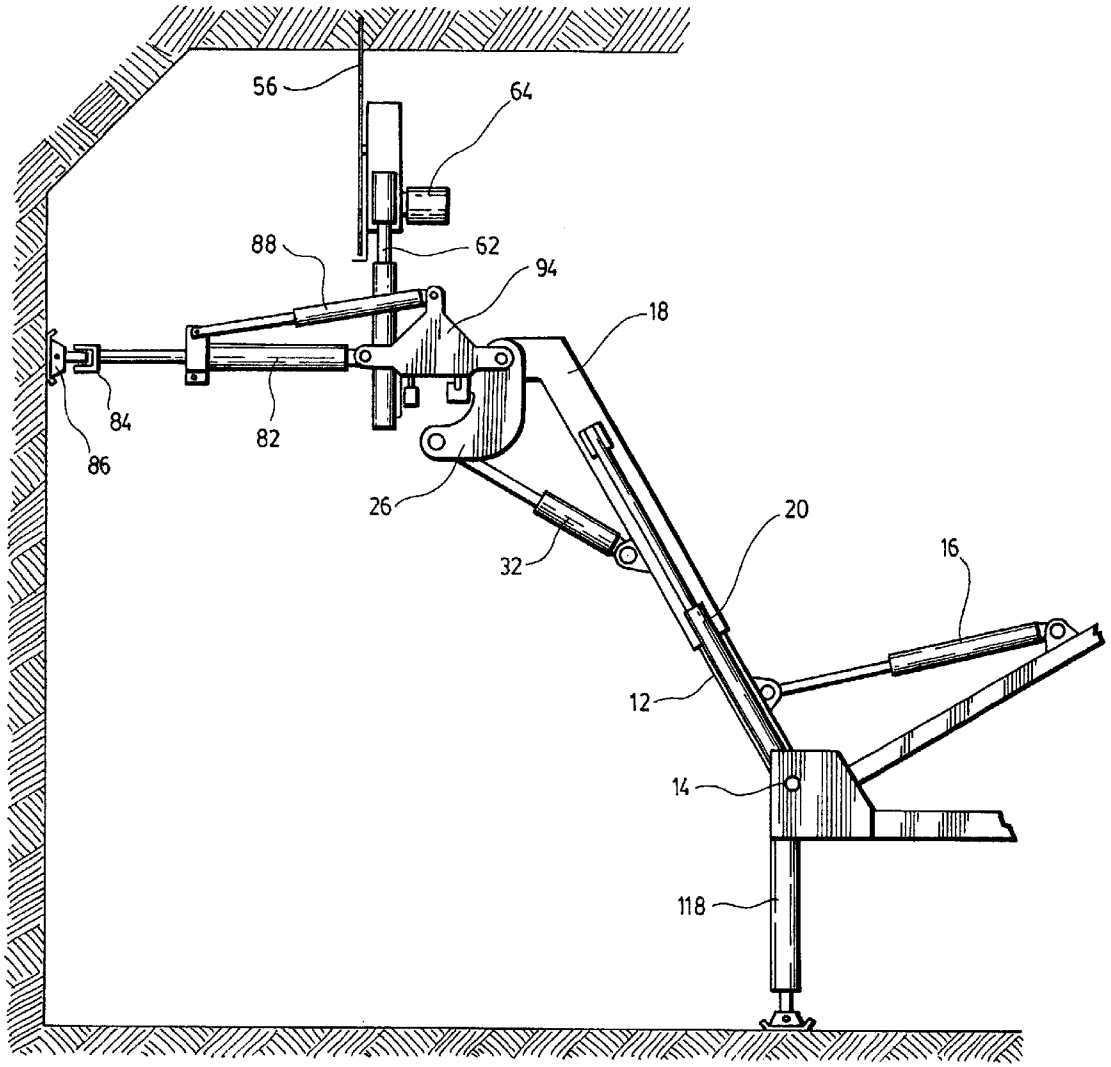
FIG. 5 is a side elevational view similar to the one of FIG. 4, showing the machine positioned for making a groove into a ceiling-like surface.
Figure 7:
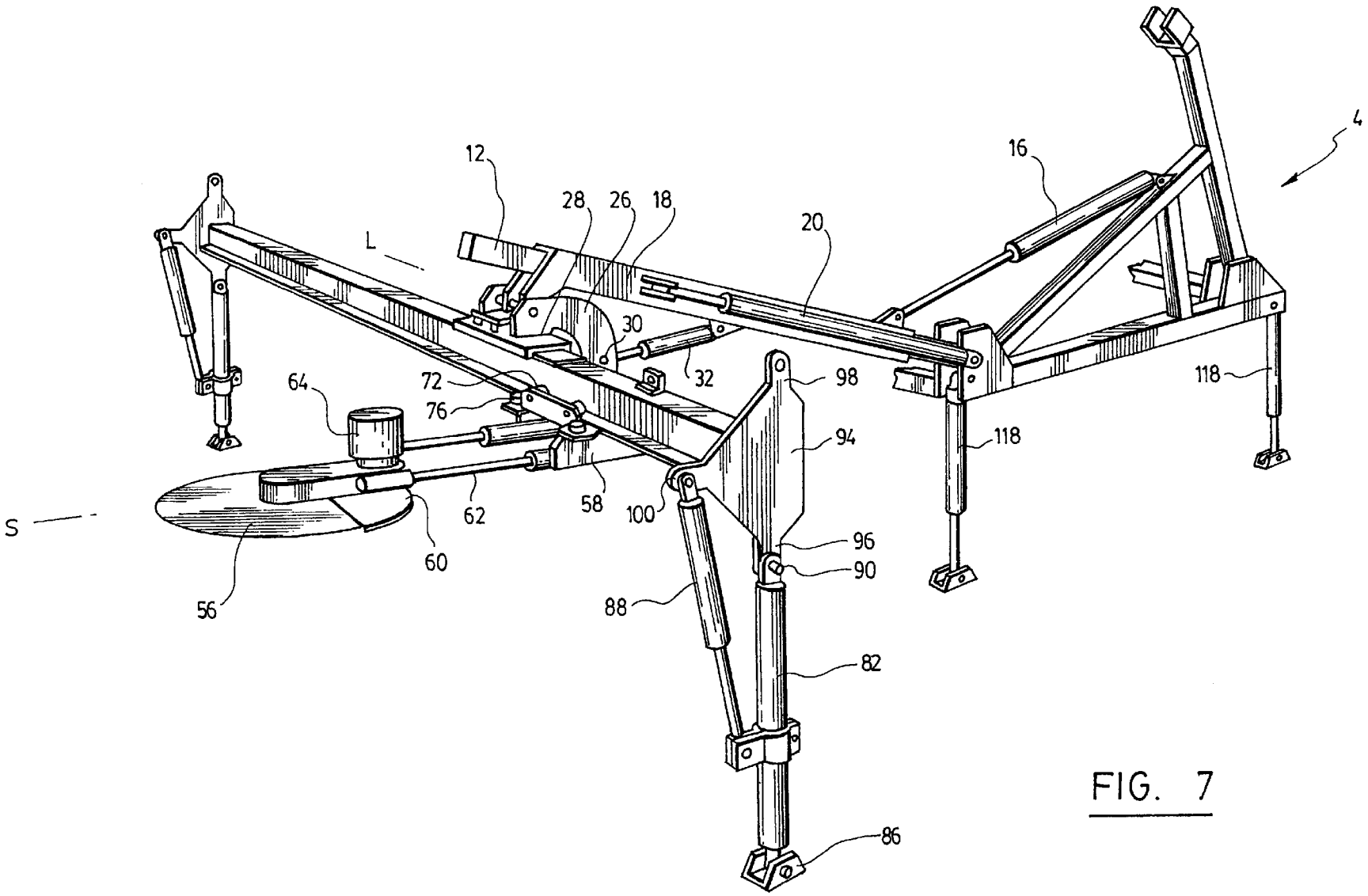
FIG. 7 is a partial perspective view of the machine shown in FIG. 2.

As is also shown in FIGS. 3, 5 and 7, the apparatus (10) comprises two spaced-apart booms (12) which are parallel to each other. Each of these booms (12) has one end (14) pivotally mounted on the base (4). The apparatus (10) also comprises tilting means mounted on the base (4) to tilt the parallel booms (12) vertically in unison about their one end (14). The tilting means preferably consist of powered jacks (16) Each of these jacks (16) interconnects the base (4) and a corresponding boom (12) in such way that the extension and contraction of the powered jacks (16) in unison, permit to tilt the booms (12) up and down as shown in FIG. 3.

Figure 16:
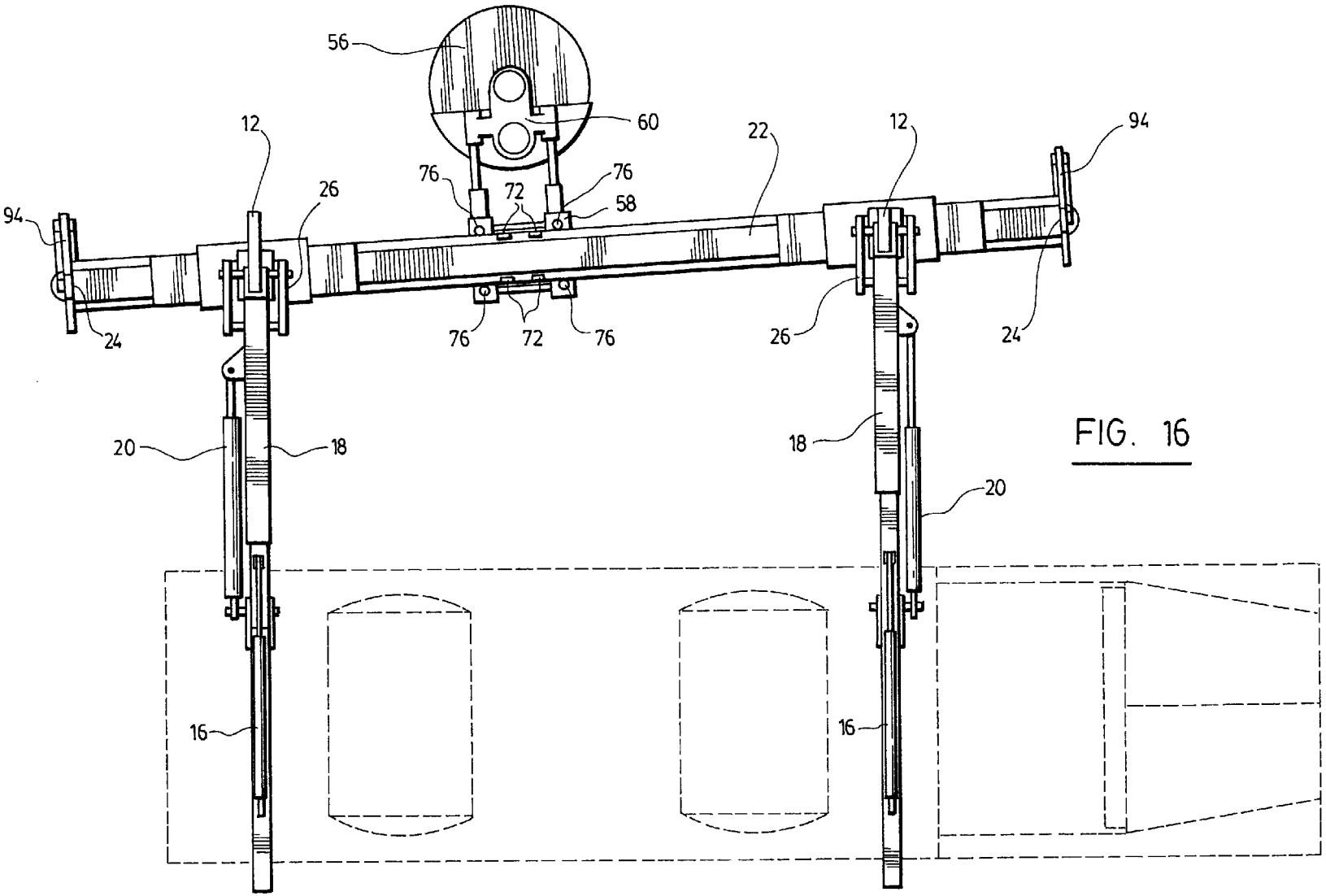
FIG. 16 is a view similar to the one of FIG. 2, showing the main rail at an angle slightly different than 90° with each boom.

The apparatus (10) also comprises a rail-structure-holding head (18) slidably mounted on each parallel boom (12) and sliding means to slide each head (18) separately along its respective boom (12). The sliding means preferably consist of powered jacks (20). Each jack (20) interconnects one of the heads (18) and the corresponding boom (12). These jacks (20) may expand and contract independently in such a way that each head (18) may be positioned differently from the other along its respective boom (12) as is shown in FIG. 16 in comparison with FIG. 2.

Figure 6:
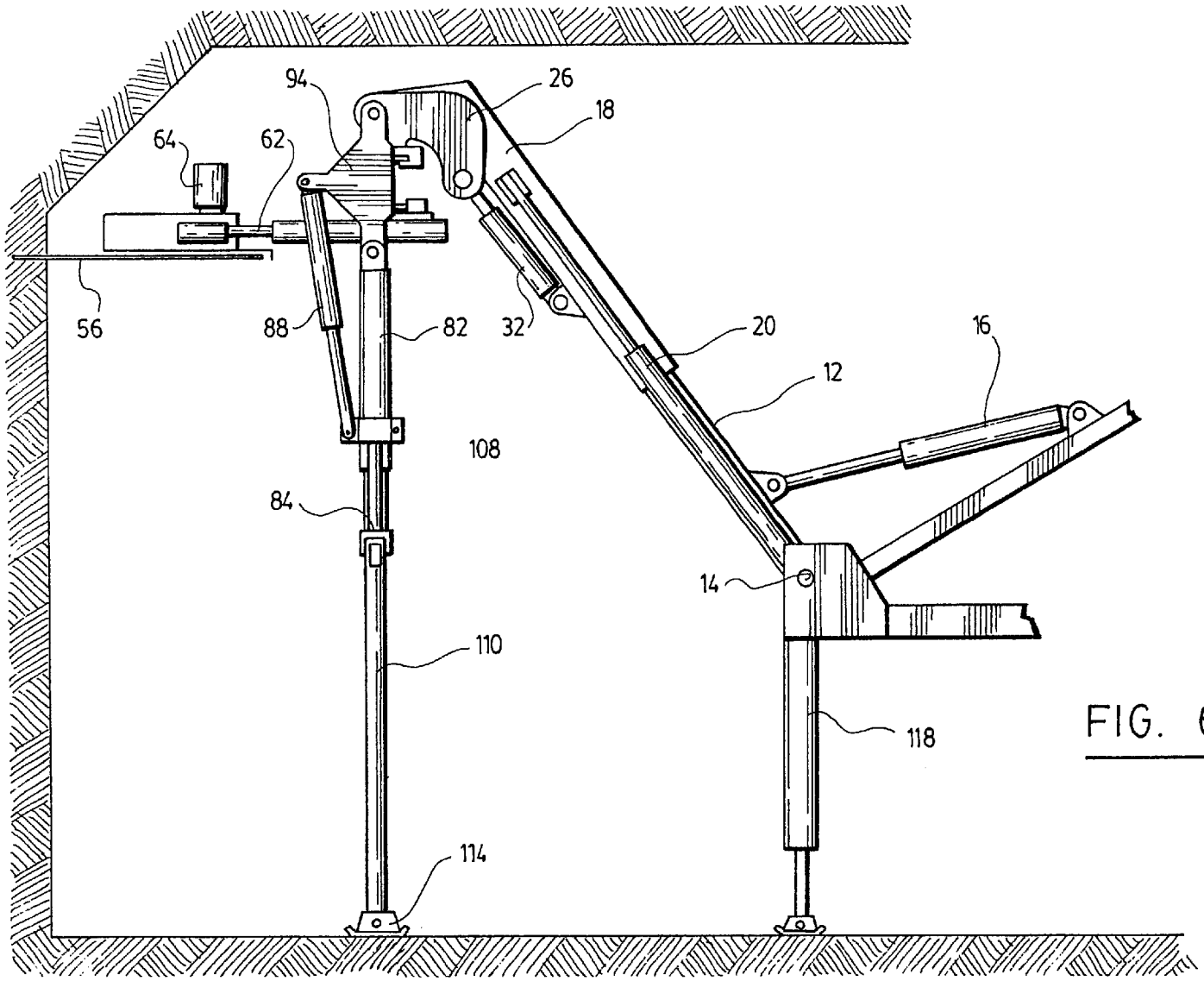
FIG. 6 is a side elevational view similar to those of FIGS. 4 and 5, showing the machine positioned for making a groove into a wall-like surface.
Figure 17:
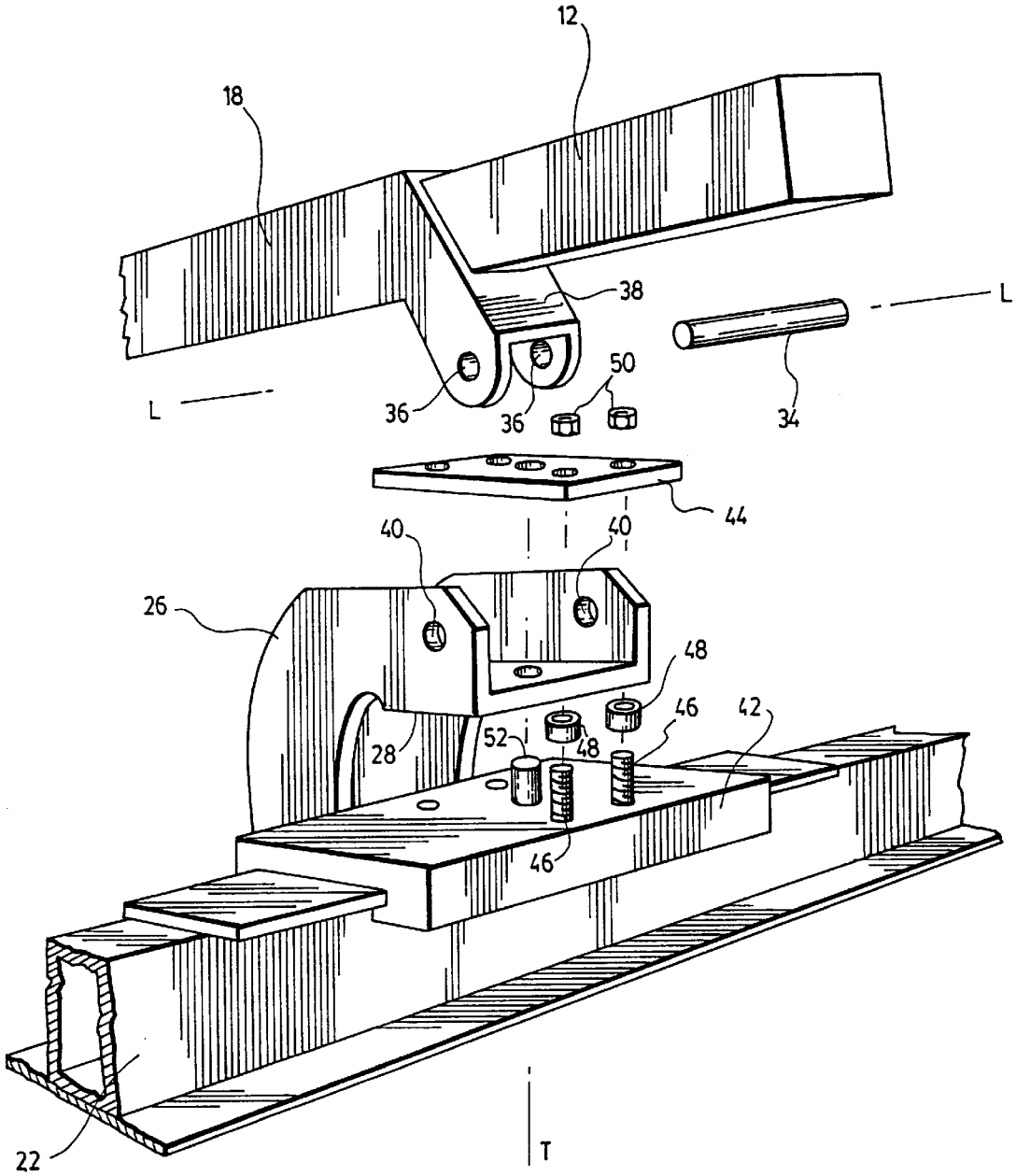
FIG. 17 is a partial exploded perspective view of the pivoting connection of one of the curved support members of the machine according to the invention, showing the respective head and the support means for pivotally mounting the curved support member on the main rail.

The apparatus (10) further comprises an elongated main rail (22) having a pair of opposite ends (24) and means for mounting the main rail (22) on the heads (18) for rotation about a longitudinal axis (L) parallel to said elongated main rail (22). The longitudinal axis (L) and the means for mounting the main rail (22) are clearly shown in FIG. 17. The means for mounting the main rail (22) comprise curved support members (26). Each curved support member (26) is pivotally connected to a corresponding head (18) for rotation about the longitudinal axis (L). Each curved support member (26) also has a first end (28) on which the main rail (22) is pivotably mounted by a support means about a transversal axis (T) perpendicular to the longitudinal axis (L), and a second end (30). Power means are provided between the second end (30) of each curved support member (26) and the corresponding head (18) for levering the first end (28) of the curved support member (26) and, therefore, for rotating the main rail (22) about the longitudinal axis (L). Preferably, the power means include powered jacks (32). Referring to FIG. 17, the pivoting connection of each curved support member (26) to its corresponding head (18) includes a pin (34) extending along the longitudinal axis (L) and passing through holes (36) into an extension (38) of the respective head (18) and holes (40) into the curved support member (26). As can be noticed, the means described hereinabove for mounting the main rail (22) on the heads (18) allow the main rail (22) to rotate about the longitudinal axis (L) within a wide angle of rotation. Two different positions of rotation of the main rail (22) are illustrated in FIGS. 5 and 6. Thus, the means for mounting the main rail (22) on the heads (18) of the present invention is one of the main improvements of the present invention over the machine disclosed and claimed in Canadian patent no. 1,253,420. It allows more rotation of the main rail (22) about the longitudinal axis (L) and thus allows the machine (1) to cut into a surface enclosed in a wider area.

Referring more particularly to FIG. 17, the support means for pivotably mounting the first end (28) of each curved support member (26) on the main rail (22) comprises a first plate (42) fixed on the main rail (22) and a second plate (44) that is rigidly connected to the first plate (42) in a spaced apart relationship by four sets of bolts and nuts. Each set includes a bolt (46), a spacer (48) and a nut (50). The first and second plates (42, 44) together define a gap in which the first end (28) of the curved support member (26) is pivotably mounted about a pivot pin (52) that extends along the transversal axis (T) from and between the first and second plates (42, 44). The first end (28) of each curved support member (26) is sandwiched between the first and second plates (42, 44) and may pivot around the pivot pin (52), thereby allowing the main rail (22) to make an angle slightly different than 90° with each boom (12) when the heads (18) are positioned differently along their respective booms (12) as is shown in FIG. 16.

Figure 10:
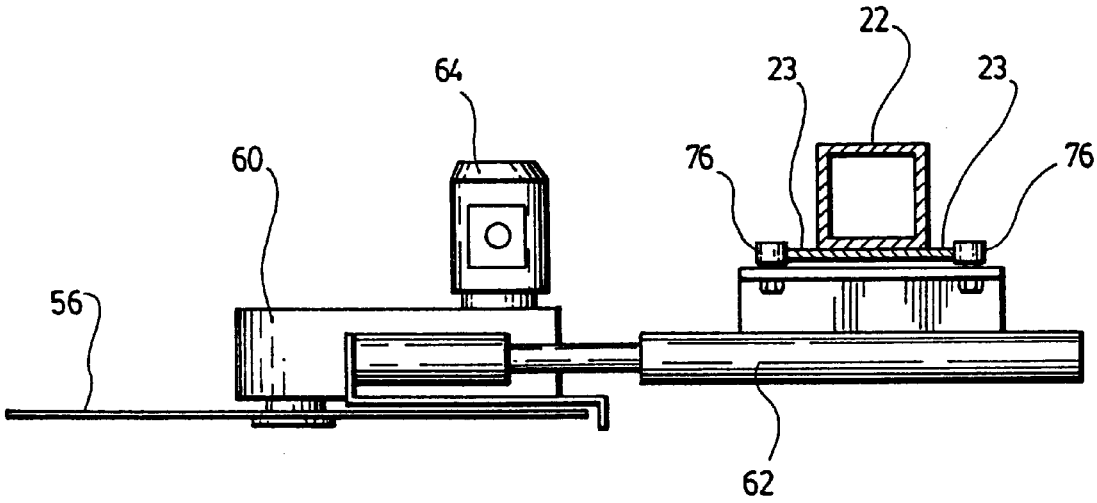
FIG. 10 is a cross-sectional view taken along line X—X of FIG. 9, showing the other spacer wheels of the saw carrier.

Referring now to FIGS. 8, 9 and 10, the apparatus (10) further comprises a saw carrier (54) mounted on the main rail (22). Displacing means are provided for moving the saw carrier (54) along the main rail (22) in a first direction (F) parallel to the longitudinal axis (L). A motorized saw (56) is mounted on the saw carrier (54) and means are provided on the saw carrier (54) for displacing the saw (56) on it in a second direction (S) perpendicular to the first direction (F). The saw carrier (54) comprises a first part (58) mounted on the main rail and a second part (60) carrying the saw (56). The first and second parts (58, 60) are interconnected by the saw displacing means which preferably include two powered jacks (62) projecting in the second direction (S). The saw displacing means disclosed hereinabove is another one of the improvements made to the machine disclosed and claimed in Canadian patent no.1,253,420. It provides a simple and solid way for displacing the saw (56). The second part (60) of the saw carrier (54) holds a motor (64) which is offset with respect to the saw (56) and operates the saw (56) through a gearing (66). Thanks to the particular structure and positioning, the saw (56) may penetrate more deeply into the groove that is being cut, because the motor (64) is offset with respect to the saw (56).

The displacing means for moving the saw carrier (54) along the main rail (22) along the first direction (F) comprises means for slidingly mounting the saw carrier (54) along the main rail (22). It also comprises a toothed rack (68) solid with and extending all along the main rail (22), and a powered pinion wheel (70) mounted on the saw carrier (54) and adapted to engage the toothed rack (68). Preferably, the means for slidingly mounting the saw carrier (54) along the main rail (22) includes four upper spacer wheels (72) which extend on both sides of the main rail (22) and are spaced apart from each other. The upper spacer wheels (72) are mounted on the saw carrier (54) and positioned in such a way that they are lying on opposite borders (23) of the main rail (22) and may roll on it along the first direction (F). The means for slidingly mounting the saw carrier (54) along the main rail (22) also includes four lower spacer wheels (74) and four side spacer wheels (76). The lower spacer wheels (74) are also mounted on the saw carrier (54) and are positioned under each upper spacer wheels (72) in order to sandwich the borders (23) of the main rail (22) and also roll on it along the first direction (F). The side spacer wheels (76) also mounted on the saw carrier (54), separated on both sides of the main rail (22) and spaced apart from each other, are positioned in order to roll onto the edge of the borders (23) and guide the saw carrier (54) along the main rail (22). As illustrated in FIG. 8, a motor (78) is mounted on one side of the saw carrier (54) and operates the pinion wheel (70) through a rod (80) extending under the main rail (22) in such a way that the pinion wheel (70) engages the toothed rack (68) under the main rail (22). The toothed rack (68) is better illustrated in FIGS. 11 and 12. Rotation of the powered pinion wheel (70) by means of the motor (78) moves the saw carrier (54) along the main rail (22). More particularly, the saw carrier (54) slides onto the borders (23) with the help of the spacer wheels (72, 74, 76).

Figure 13:
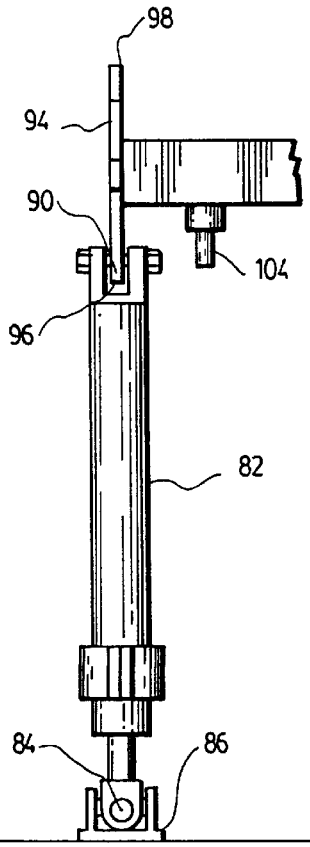
FIG. 13 is a partial front view of FIG. 7, showing the leg in a contracted position.
Figure 14:
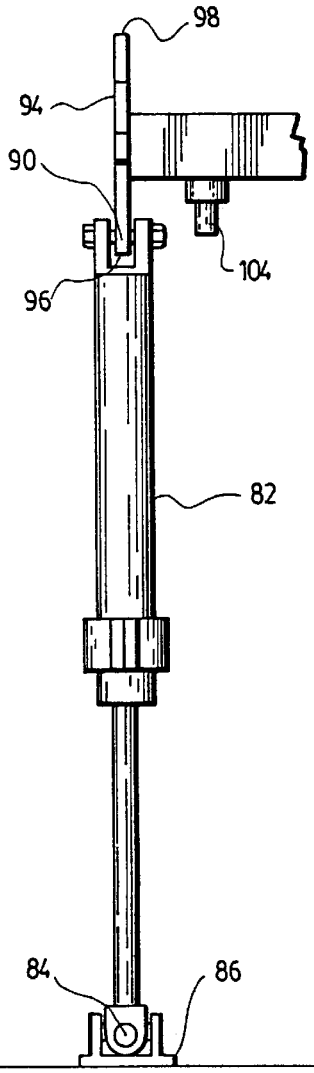
FIG. 14 is a view similar to the one of FIG. 13, showing the leg in an extended position.

Referring to FIGS. 13 and 14 among others, each opposite end (24) of the main rail (22) includes a powered extendible leg (82) for stabilizing the apparatus (10) whenever required. Each leg (82) has a remote end (84) with a foot (86) attached on it. Means are provided for orienting each leg (82) in a third direction (H) perpendicular to the longitudinal axis (L) and perpendicular to the surface in such way that each foot (86) lies on the surface and thus stabilizes the apparatus (10). These legs (82) are used to stabilize the apparatus (10) especially while the saw (56) is in operation. Preferably, the powered extendible legs (82) are powered jacks. FIGS. 13 and 14 show the extendible legs (82) in contraction and extension respectively.

As clearly illustrated in FIG. 7, each opposite end (24) of the main rail (22) has a triangular support plate (94) rigidly connected thereto. The triangular support plate (94) extends in a plane perpendicular to the longitudinal axis (L) and has first and second tips (96, 98) that are in opposite positions with respect to the second direction (S) in which the saw (56) is displaced. The triangular support plate (94) also has a third tip (100).

The means for orienting each leg (82) comprise a powered jack (88) pivotably connected to the third tip (100) of the triangular support plate (94) and to the corresponding leg (82), respectively. These means for orienting the legs (82) are particularly helpful because they enable the operator of the machine (1) to position each leg (82) perpendicularly to the surface, at a distance. Such becomes a need in the position illustrated in FIG. 5 where the legs (82) are up. These orienting means are also another one of the improvements of the machine according to the invention over the one disclosed and claimed in Canadian patent no.1,253,420. They give new operational possibilities to the machine, especially for making grooves into a ceiling or a wall as well. They also simplify the operation for cutting a floor.

Figure 4:
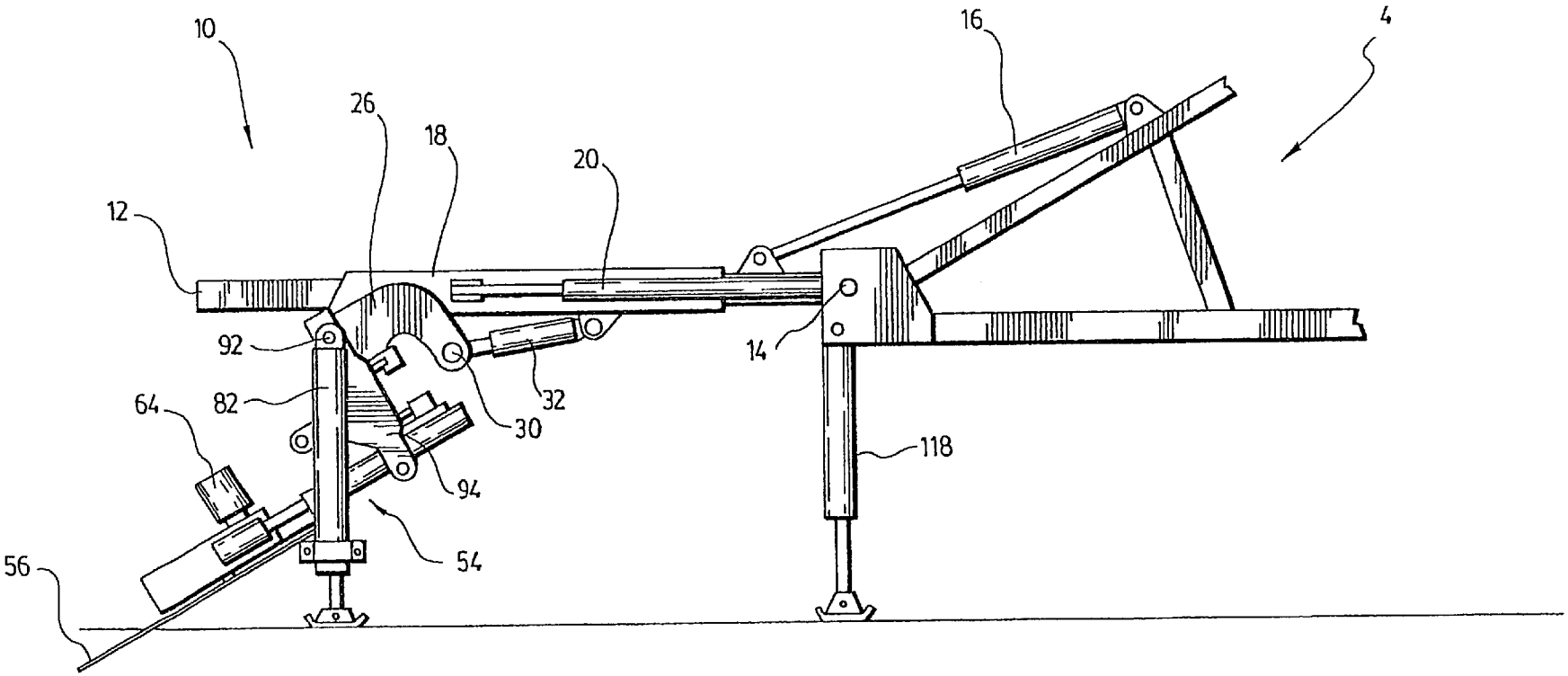
FIG. 4 is another side elevational view of the machine according to the inventions positioned for making a groove into a floor-like surface.
Figure 11:
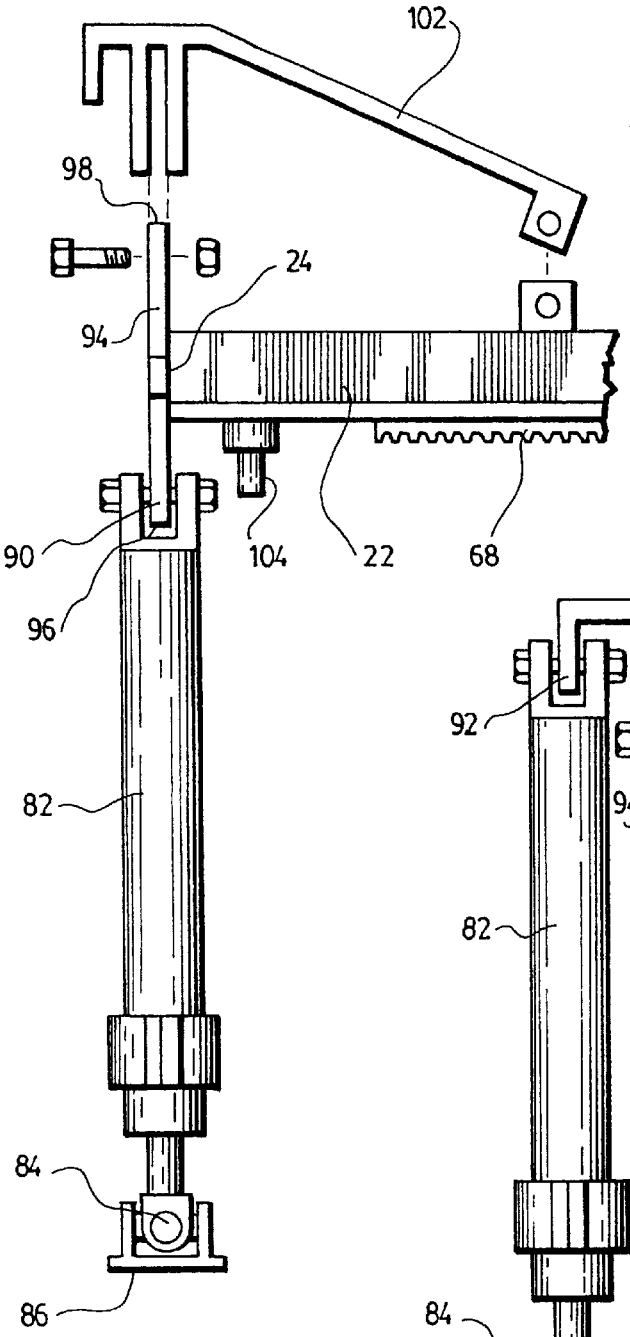
FIG. 11 is a partial front view of FIG. 7, showing the leg with an exploded representation of an adapter piece.
Figure 12:
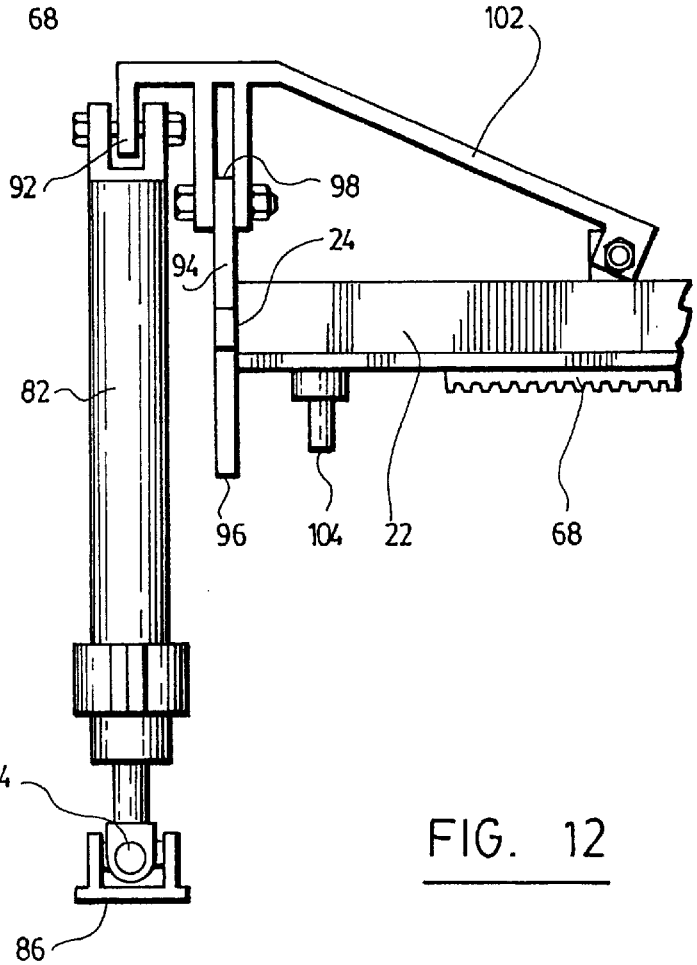
FIG. 12 is a partial front view of FIG. 4, showing the leg.

Each opposite end (24) of the main rail (22) further includes first and second places (90, 92) to which the corresponding leg (82) is attached. The first and second places (90, 92) are spaced apart in such a way that when the leg (82) is attached to the second place (92) as shown in FIG. 12, it extends less than when the same leg (82) is attached to the first place (90) as shown in figurel 1. The first and second places (90, 92) to attach the corresponding leg (82) are respectively located at the first and second tips (96, 98) of the triangular support plate (94). More particularly, the second places (92) are located indirectly at the second tip (98) by means of adaptors (102), while the first places (90) are located directly at the first tip (96). Preferably, the adaptors (102) are directly attached to the second tip (98) of the triangle support plate (94) and the main rail (22) as illustrated in FIGS. 11 and 12. Installation of the legs (82) at the second places (92) allows the saw (56) to get closer to a floor-like surface and to make a deeper groove therein or with a lower angle as illustrated in FIG. 4. The option to less extend the legs (82) is also another improvement made over Canadian patent no.1,253,420.

Figure 15:
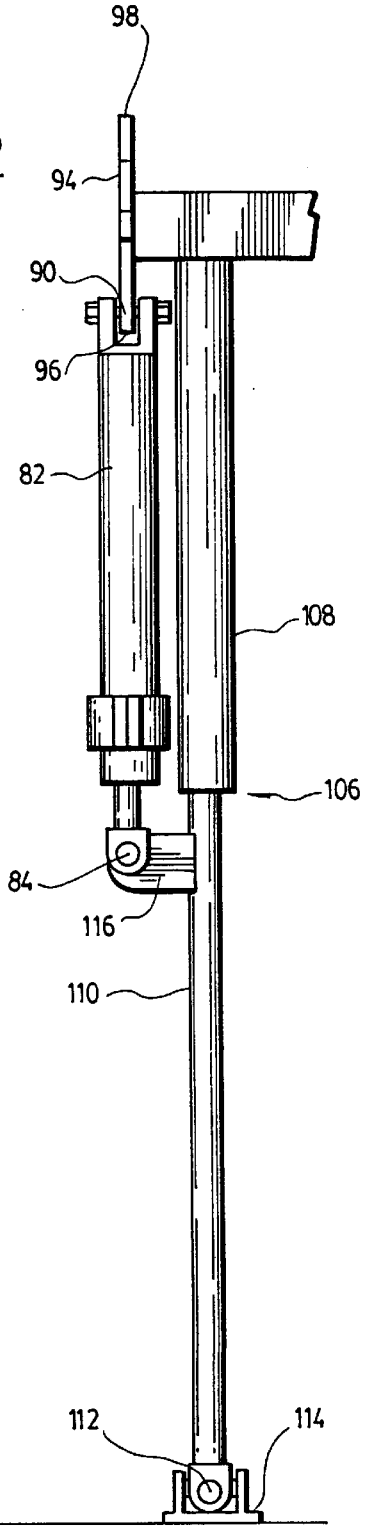
FIG. 15 is a partial front view of FIG. 6, showing the leg.

Referring more particularly to FIGS. 6 and 15, each end (24) of the main rail (22) further includes a third place (104) to receive and install a supporting element (106) extendable in a given direction perpendicular to the longitudinal axis (L). Each element (106) comprises a first portion (108) attached to the third place (104) and a second telescopically mounted portion (110). Each second portion (110) has a remote end (112) on which a foot (114) is mounted, and fixation means (116) on which the remote end (84) of the leg (82) is connected after removal of the corresponding foot (86). It is noteworthy that the foot (114) of each supporting element (106) is designed to be interchangeable with the foot (86) of each leg (82). The extension and contraction of the legs (82) force the second portion (110) to slide inside the first portion (108). In other words, the supporting element (106) performs as an extension of the legs (82) thereby allowing it to reach the floor-like surface when the saw (56) is cutting high up into the wall, and therefore stabilizing the apparatus (10) in such an operation as particularly illustrated in FIG. 6. When the legs (82) are connected to the supporting elements (106), the orienting means also permit to adapt the orientation of each leg (82) and thus of each supporting element (106) so that it is perpendicular to the surface. The option of extending more the legs (82) is a further one of the main improvements of the present invention over the one disclosed and claimed in Canadian patent no.1,253,420. Indeed, it allows for the stabilization of the apparatus (10) during its operation whatever its position.

The support base (4) of the machine (1) comprises at least two extendible, ground-contacting legs (118) to stabilize the apparatus (10) whenever required. More particularly, the apparatus (10) is stabilized by four support base legs (118) as partially shown in FIG. 1, 3 or 7. These legs (118) also allow for the stabilization of the whole machine (1) during every movement of the apparatus (10) such as positioning or operating the saw (56).

As can be appreciated, the machine (1) according to the present invention, is designed to be able to make a groove into a floor-like surface as well as a ceiling or wall-like surface at almost any possible angle. This machine (1) has been construed especially for making a groove in a road tunnel in order to renovate such a tunnel. The machine (1) is preferably equipped with a circular diamond saw (56) in such a way that it can succeed to cut any hard material.

It should be noted that all powered jacks are preferably hydraulic cylinders. However, use could also be made of endless screws. It should also be noted that the displacing means for moving the saw carrier (54) along the main rail (22) could alternatively consist of a chain system instead of the pinion wheel and toothed rack system disclosed herein-above. It should be further noted that the machine according to the present invention could include only one of the very specific improvements.

Thus, although a preferred embodiment of the invention has been described in detail herein, and illustrated in the accompanying drawings, it is to be understood that the invention is not limited to the precise embodiment and that various changes and modifications may be effected therein without departing from the scope or the spirit of the invention.

What is claimed is:

1. A machine including a powered truck-like vehicle having a support base and an apparatus mounted on the base for making a groove into a surface, the apparatus comprising:

two spaced-apart booms, said two booms being parallel to each other and each having one end pivotally mounted on the base;

tilting means mounted on said base to tilt the parallel booms vertically in unison about their one ends;

a rail-structure-holding head slidably mounted on each of said parallel booms;

sliding means to slide each head separately along its respective boom;

an elongated main rail having a pair of opposite ends;

means for mounting the main rail on said heads for rotation about a longitudinal axis parallel to said elongated main rail, said means for mounting the main rail comprising:

curved support members, each said curved support member being pivotally connected to its respective head for rotation about said longitudinal axis, and having a first end on which said main rail is pivotably mounted by a support means about a transversal axis perpendicular to said longitudinal axis, and a second end;

power means extending between the second end of each curved support member and the respective head for levering the first end of said curved support member and, therefore, for rotating said main rail about said longitudinal axis;

a saw carrier mounted on the main rail;

displacing means for moving the saw carrier along the main rail in a first direction parallel to the longitudinal axis;

a motorized saw mounted on said saw carrier;

means on the saw carrier for displacing the saw on said saw carrier in a second direction perpendicular to said first direction;

a powered extendible leg mounted on each opposite end of the main rail for stabilizing said apparatus whenever required;

each leg being mounted pivotally on the main rail so that each leg can be rotated with respect to the main rail; and each leg being fixable with respect to the main rail so that each leg can be rotated with the main rail around the longitudinal axis.

2. A machine as claimed in claim 1, wherein the saw carrier comprises a first part mounted on the main rail and a second part carrying the saw, said first and second parts being interconnected by said saw displacing means which comprise at least one powered jack projecting in said second direction.

3. A machine as claimed in claim 2, wherein the second part of the saw carrier holds a motor which is offset with respect to the saw and operates said saw through a gearing.

4. A machine as claimed in claim 1, wherein each leg has a remote end with a foot attached to it; and means for orienting each leg in a third direction perpendicular to said longitudinal axis and perpendicular to the surface in such a way that each foot lies on the surface and thus stabilizes the apparatus.

5. A machine as claimed in claim 4, wherein each opposite end of the main rail further includes first and second places to which the corresponding leg is attached, said first and second places being spaced apart in such a way that when the leg is attached to the second place, it extends less than when said leg is attached to the first place.

6. A machine as claimed in claim 4, wherein the saw carrier comprises a first part mounted on the main rail and a second part carrying the saw, said first and second parts being interconnected by the means for displacing the saw on the saw carrier which comprise at least one powered jack projecting in said second direction.

7. A machine as claimed in claim 6, wherein the second part of the saw carrier holds a motor which is offset with respect to the saw and operates said saw through a gearing.

8. A machine as claimed in claim 1, wherein the support means for pivotably mounting the first end of each curved support member on the main rail comprises a first plate fixed on the main rail and a second plate that is rigidly connected to the first plate in a spaced apart relationship, said first and second plates defining a gap in which the first end of the curved support member is pivotably mounted about a pivot pin that extends along said transversal axis from and between the first and second plates.

9. A machine as claimed in claim 1, wherein the support base comprises at least two extendible, ground-contacting legs for stabilizing the apparatus whenever required.

10. A machine as claimed in claim 1, wherein the displacing means for moving the saw carrier along the main rail comprise:

means for slidingly mounting the saw carrier along the main rail;

a toothed rack solid with and extending all along the main rail; and a powered pinion wheel mounted on the saw carrier and adapted to engage the toothed rack.

11. A machine including a powered truck-like vehicle having a support base and an apparatus mounted on the base for making a groove into a surface, the apparatus comprising:

two spaced-apart booms, said two booms being parallel to each other and each having one end pivotally mounted on the base;

tilting means mounted on said base to tilt the parallel booms vertically in unison about their one ends;

a rail-structure-holding head slidably mounted on each of said parallel booms;

sliding means to slide each head separately along its respective boom;

an elongated main rail having a pair of opposite ends;

means for mounting the main rail on said heads for rotation about a longitudinal axis parallel to said elongated main rail, said means for mounting the main rail comprising:

curved support members, each said curved support member being pivotally connected to its respective head for rotation about said longitudinal axis, and having a first end on which said main rail is pivotably mounted by a support means about a transversal axis perpendicular to said longitudinal axis, and a second end;

power means extending between the second end of each curved support member and the respective head for levering the first end of said curved support member and, therefore, for rotating said main rail about said longitudinal axis;

a saw carrier mounted on the main rail;

displacing means for moving the saw carrier along the main rail in a first direction parallel to the longitudinal axis;

a motorized saw mounted on said saw carrier;

means on the saw carrier for displacing the saw on said saw carrier in a second direction perpendicular to said first direction; and a powered extendible leg mounted on each opposite end of the main rail for stabilizing said apparatus whenever required, each leg having:

a remote end with a foot attached to it; and means for orienting each leg in a third direction perpendicular to said longitudinal axis and perpendicular to the surface in such a way that each foot lies on the surface and thus stabilizes the apparatus; wherein each opposite end of the main rail has a triangular support plate rigidly connected thereto, said triangular support plate extending in a plane perpendicular to said longitudinal axis and having:

a first lip and a second lip that are in opposite positions with respect to the second direction in which the saw is displaced, the first and second tips providing respectively a first place and a second place to which the leg is attached, said first and second places being spaced apart in such a way that when the leg is attached to the second place, it extends less than when said leg is attached to the first place; and a third tip; and wherein said means for orienting the corresponding leg comprise a powered jack pivotably connected to the third tip of the triangular support plate and to the corresponding leg, respectively.

12. A machine as claimed in claim 11, wherein each end of the main rail further includes a third place to receive and install a supporting element extendable in a given direction perpendicular to the longitudinal axis, said element comprising a first portion attached to the third place and a second telescopically mounted portion, said second portion having a remote end on which a foot is mounted, and fixation means on which the remote end of the leg is connected after removal of the corresponding foot.

13. A machine as claimed in claim 12, wherein the foot of each supporting element is interchangeable with the foot of each leg.

14. A machine as claimed in claim 12, wherein the saw carrier comprises a first part mounted on the main rail and a second part carrying the saw, said first and second part being interconnected by the means for displacing the saw on the saw carrier which comprise at least one powered jack projecting in said second direction, the second part of the saw carrier holding a motor which is offset with respect to the saw and operates said saw through a gearing.

15. A machine as claimed in claim 14, wherein the support means for pivotably mounting the first end of each curved support member on the main rail comprises a first plate fixed on the main rail and a second plate that is rigidly connected to the first plate in a spaced apart relationship, said first and second plate defining a gap in which the first end of the curved support member is pivotably mounted about a pivot pin that extends along said transversal axis from and between the first and second plates.

16. A machine as claimed in claim 15, wherein the displacing means for moving the saw carrier along the main rail comprise:

means for slidingly mounting the saw carrier along the main rail;

a toothed rack solid with and extending all along the main rail; and a powered pinion wheel mounted on the saw carrier and adapted to engage the toothed rack.

17. A machine as claimed in claim 16, wherein the support base comprises at least two extendible, ground-contacting legs for stabilizing the apparatus whenever required.

18. A machine as claimed in claim 12, wherein the support means for pivotably mounting the first end of each curved support member on the main rail comprise a first plate fixed on the main rail and a second plate that is rigidly connected to the first plate in a spaced apart relationship, said first and second plate defining a gap in which the first end of the curved support member is pivotably mounted about a pivot pin that extends along said transversal axis from and between the first and second plates.

19. A machine as claimed in claim 18, wherein the displacing means for moving the saw carrier along the main rail comprise:

means for slidingly mounting the saw carrier along the main rail;

a toothed rack solid with and extending all along the main rail; and a powered pinion wheel mounted on the saw carrier and adapted to engage the toothed rack.

20. A machine as claimed in claim 19, wherein the support base comprises at least two extendible, ground-contacting legs for stabilizing the apparatus whenever required.

* * * * *